US005439224A

United States Patent [19]

Bertoncino

[11] Patent Number: 5,439,224

[45] Date of Patent: Aug. 8, 1995

[54] DRIVING RANGE WITH AUTOMATED SCORING SYSTEM

[76] Inventor: James Bertoncino, 6236 N. 16th St., No. 42, Phoenix, Ariz. 85016

[21] Appl. No.: 136,479

[22] Filed: Oct. 13, 1993

Related U.S. Application Data

[63] Continuation of Ser. No. 894,559, Jun. 5, 1992, abandoned.

[51] Int. Cl.[6] ..... A63B 69/36

[52] U.S. Cl. ..... 273/182 A; 273/35 R; 273/181 H; 273/213; 273/58 R

[58] Field of Search ..... 273/14, 32 R, 176, 34 R, 273/62, 177 R, 213, 178 R, 179, 354, 184 R, 187, 3, 35 B, 183.1, 389, 394, 396, 397, 398, 113, 125 A, 180, 181, 178

[56] References Cited

U.S. PATENT DOCUMENTS

| | | | |
|---|---|---|---|
| 2,825,565 | 3/1958 | Hooker | 273/125 A |
| 3,104,879 | 9/1963 | Jetton | 273/176 |
| 3,708,173 | 1/1973 | Hewsom, Jr. | 273/182 R |
| 3,782,730 | 1/1974 | Horchler | 273/213 |
| 3,868,692 | 2/1975 | Woodard et al. | 343/112 |
| 3,897,947 | 8/1975 | Heffley Jr. | 273/371 |
| 3,897,947 | 8/1975 | Heffley | 273/176 A |
| 4,660,039 | 4/1987 | Barricks et al. | 342/27 |
| 5,029,866 | 7/1991 | Beard, III et al. | 273/181 R |
| 5,033,745 | 7/1991 | Sullivan et al. | 273/182 R |
| 5,066,008 | 11/1991 | Rivera | 273/14 |
| 5,083,113 | 1/1992 | Slawinski et al. | 273/371 |
| 5,114,155 | 5/1992 | Tillery et al. | 273/371 |
| 5,163,677 | 11/1992 | Foley | 273/181 H |
| 9,042,491 | 8/1977 | Hazeltine et al. | 273/14 |

FOREIGN PATENT DOCUMENTS

| | | | |
|---|---|---|---|
| 2119261 | 11/1983 | United Kingdom | 273/183.1 |

*Primary Examiner*—Mark S. Graham
*Attorney, Agent, or Firm*—Nell & Wilmer

[57] ABSTRACT

A golf range comprising a series of independent targets, each of which consists of a sloped area located at a different distance from a multiplicity of tee stands. The range is also equipped with a scoring system that uses Universal Product Codes on each ball, optical scanners located at each target, and a programmed computer to identify each ball passing through the target and to record pertinent information and statistics to provide golfers with a record of the number and length of shots taken. The computer is also programmed to provide a comparison of information from previous sessions for a particular golfer or other golfers. In another embodiment, the invention also comprises a multilevel vertical target for driver shots located at a fixed distance from each tee stand, wherein each level includes a receiving net and a gutter connected to the system of pipes for the return of the balls.

24 Claims, 4 Drawing Sheets

TODAY'S STATISTICS

| TARGET | | YDS | HITS | POINTS |
|---|---|---|---|---|
| 1 | INNER ZONE | | | |
| | OUTER ZONE | | | |
| 2 | " " | | | |
| 3 | " " | | | |
| | " " | | | |
| 4 | " " | | | |
| | | | | |
| 5 | " " | | | |
| | " " | | | |
| 6 | DRIVING ZONES | | | |
| | | | | |
| | | | | |
| TOTALS | | | | |

RECORD BOOK

| | THIS MONTH | TOTAL SCORE YT/D | ALL TIME | AVG |
|---|---|---|---|---|
| YOUR NAME | | | | |
| WOMEN: NAME SCORE | | | | |
| MEN: NAME SCORE | | | | |

PERCENTAGES

| | THIS MONTH | Y/T/D | ALL TIME | AVG |
|---|---|---|---|---|
| YOUR NAME | | | | |
| WOMEN: NAME % | | | | |
| MEN: NAME % | | | | |

DRIVING RANGE WITH AUTOMATED SCORING SYSTEM

This is a file wrapper continuation of application Ser. No. 07/894,559, filed Jun. 5, 1992, abandoned.

BACKGROUND OF THE INVENTION

1. Field of the Invention

This invention relates to the general field of golf equipment and driving and/or chipping ranges. More particularly, it relates to an improved range using Universal Product Code labeling and optical scanner technology, which provides golfers with entertainment and an opportunity to improve their distance and directional skills for driving and/or chipping.

2. Description of the Prior Art

Golf driving and chipping ranges traditionally are of a type that permits a golfer to rent, for a fee, a bucket of balls which the golfer then propels using a golf club in a manner described in the sport of golf as driving or chipping. The balls are hit from a tee stand located in a marked stall or area onto a range normally equipped with markers that numerically indicate the distance from the tee stand, thereby enabling the golfer to estimate or determine the length of his drive or chip. The golfer's ability to judge the length of his drive or chip is dependent upon his ability to follow visually the path of the ball and to see the lie (the actual spot where the ball lands after being hit). That ability may be impaired or adversely affected by one or any combination of several factors, such as the golfer's eyesight; inadequate lighting attributable to natural shading, time of day or dim or poorly directed artificial light; excessively bright lighting from the sun or from poorly directed artificial light; natural physical obstructions such as trees, bushes, grasses, terrain imperfections; and the presence of other balls that have come to lie at approximately the same place and are generally indistinguishable from each other even at relatively short distances. Accordingly, one objective of this invention is to provide a means for measuring with a degree of exactness the length of the golfers' drive or chip without depending on his ability to follow visually the path of the ball.

Conventional driving or chipping ranges are traditionally configured with tee stands or stalls located in a straight line with distance markers measured perpendicularly from the line; the farthest marker is generally about 200 to 250 yards from the tee stands. Notwithstanding the golfer's need to follow visually the path of the ball and see the lie, the ability of the golfer to make a determination with any degree of accuracy as to the length of a particular drive or chip is also dependent on the golfer's ability to judge the distance of the imaginary line parallel to the tee stands where the ball landed. In addition, since the markers only indicate distances that are perpendicular to the tee stands, they are correct for balls hit in the direction perperdicular to the tees but not for balls hit at an angle. The ball that travels either to the left or the right of that direction actually travels farther than indicated by the imaginary line parallel to the tee stands. Therefore, if the golfer chooses to drive or chip for the primary purpose of accurately gauging the length of his shots, he is limited to shots in the direction perpendicular to the tees and must sacrifice the opportunity to practice in different directions. Accordingly, it is another objective of this invention to configure a range in a manner that provides a series of targets throughout the range, each of which is located at a different angle and a different distance from each of the various tee stands, and to provide a system of accurately measuring the length of each individual shot that landed on a target using Universal Product Code labeling and optical scanning technology, thereby enabling the golfer to obtain an indication of the success of his shots, achieve an accurate measure of the length of his successful drives or chips, and have the opportunity to practice in various directions.

Conventional driving and chipping ranges do not provide golfers with a record of or statistics concerning the number and/or length of their drives and chips. In addition, because of the distraction and inconvenience involved, golfers generally do not attempt to keep these records themselves. Even if a golfer were to attempt recording the number and length of his drives on a particular occasion, the difficulty involved with keeping track of each ball and in estimating its distance from the tee would render the task practically impossible. Moreover, even if that were possible, a player would not be able to compare his skill level on that particular occasion with that achieved on other occasions unless he had also generated comparable records on previous times and had calculated accurate and meaningful statistics for comparison. Even so, these records would not provide him with the ability to make comparisons with other golfers unless they were also able and willing to do the same. Obviously, that is an impractical and almost impossible objective to achieve with a conventional driving-range setup. Accordingly, it is also an object of this invention to provide a range equipped with automated apparatus using Universal Product Code labeling and optical scanning technology to produce information and statistics on a scorecard that provides golfers with a record of the number, length and success of shots taken on a particular occasion, a comparison with previous occasions and with other golfers.

U.S. Pat. No. 3,104,879, issued to Jetton (1963), describes a driving range that affords golfers the opportunity to practice driving and chipping for distance, provides aids to improve directional accuracy and entertains by rewarding individual golfers who achieve distance and directional accuracy. This driving range envisions a plurality of flagged holes or cups, simulating a golf green, arranged at various distances from the tee stands with signaling devices to indicate when a ball drops into a cup. The invention does nor include an automated system to retrieve the balls and keep track of the golfer's performance.

U.S. Pat. No. 3,868,692, issued to Woodard et al. (1975), describes a golf yardage measuring device and system to provide a visual read-out of the distance between a golfer and a particular green on a golf course. A receiver unit in the possession of the golfer is activated by a signal emitted by a transmitter on a green, indicating the distance between the golfer and the green. The object of the invention is to assist the golfer during a game in selecting the appropriate club for his approach shot. The invention does not offer the golfer feedback to improve either distance or accuracy.

Finally, U.S. Pat. Nos. 3,868,692 to Horcheler (1974) and 4,660,039 to Barricks et al. (1987) describe electric oscillator circuits to assists in the recovery of lost golf balls and other sport objects misplaced during play, but the teachings of these patents are not utilized in any way to address the above described problems and objectives.

Therefore, there still exists a need for an automated driving range that provides a golfer with precise records of his performance during a session and a comparative analysis with his prior scores and the average performance of the public at large. The focus of this invention is a system and apparatus that give a player feedback quantifying his performance from a tee, much the same way as on approach to a green on the golf course. Having chosen a target at a given distance and in a given direction from the tee, the golfer needs to know whether the ball actually landed within the target and how close it is from the targeted spot, just as in trying to hit the cup on a green. That must be accomplished in a driving range environment where other people are hitting balls to the same and other targets at the same time.

BRIEF SUMMARY OF THE INVENTION

In accordance with the objectives stated above, this invention consists of a golf range configuration with a series of independent targets, each of which consists of a target area located at a different distance from a multiplicity of tee stands, coupled with a system of scanning equipment for the identification of the golf balls that land in a target. Each ball is labeled with Universal Product Codes recognizable by the optical scanners located within the system. Programmable computer means identifies each ball passing through each target, records pertinent information, and calculates, prints out and stores statistics that quantify the golfer's performance. A comparison of the same information from previous sessions and other golfers may also be printed out. In another embodiment, the invention also comprises a multilevel vertical target for driver shots located at a fixed distance from each tee stand, wherein each level includes a receiving net and a gutter connected to the system of pipes for the return of the balls through the scanning apparatus.

This range configuration and automated system enables the golfer to practice driver and chip shots in various directions while still being able to have an accurate measure of the length of his shots. The invention provides golfers with entertainment and an opportunity to improve their distance and directional skills, together with an ability to measure their skills against a target standard, skills of other golfers and/or their own personal past performance.

Various other purposes and advantages of the invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF PREFERRED EXEMPLARY EMBODIMENTS OF THE INVENTION

Figure 1A:
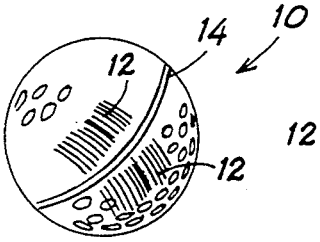
FIG. 1*a* illustrates a golf ball according to the present invention, which is coded with sets of Universal Product Code bars-printed at a fixed distance from an equatorial line.
Figure 1B:
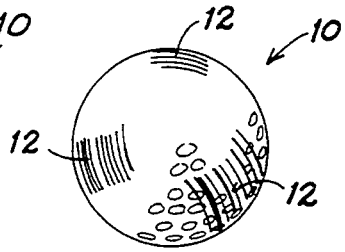
FIG. 1*b* illustrates a golf ball with sets of UPC bars positioned radially over its surface.
Figure 1C:
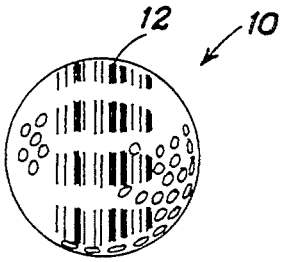
FIG. 1*c* illustrates a golf ball with sets of UPC bars repeated longitudinally along the circumference of the ball.

Referring to the drawings, wherein like parts are referenced throughout with like numerals and symbols, FIGS. 1*a*, 1*b* and 1*c* show different views of a golf ball 10, referred to herein as a coded ball, used in the operation of the invention. In accordance with a preferred aspect of the invention, the outer surface of each ball 10 is imprinted binary Universal Product Code (UPC) bars 12 in a sufficient number of sets to enable an optical scanner to read a particular code on the ball without regard to which portion of the ball surface passes in front of the scanner. To accomplish this, code labeling or imprinting preferably covers as much of the surface of the ball as is physically possible, or at least desirable, and the proper bar and background colors are be chosen for optimal resolution (such as black on white), as would be known to those skilled in the art of bar code scanning. A bar code can be selected as any alphanumeric or numeric grouping of any characteristics, and its distribution on the surface of the coded ball may vary as required by the sensitivity of the scanning equipment available. Preferably, the bar code comprises a Universal Product Code (UPC) or a Vericode, however, any number of codes or combinations thereof, or similar indicia may be suitably utilized in accordance with the present invention. The preferred bar code may be scattered randomly, or repeated longitudinally along the circumference of the ball, as illustrated in FIG. 1*c*, or radially over its surface, as in FIG. 1*b*. In order to give the scanner an added frame of reference to enhance code recognition, an equatorial line 14 may be added to the ball at a fixed distance from each set of bars, as illustrated in FIG. 1*a*.

As in the case of conventional driving ranges, the coded balls 10 are preferably distributed to golfers in containers 2 (seen in FIG. 2) filled with a predetermined number of balls. Preferably, each golfer receives a container with the same number of coded balls that he received on each previous or will receive on future occasions, and that all other golfers have received or will receive, so that meaningful statistics may be developed and retained following each shooting session. Of course, the number of balls in a set may be varied from time to time as desired or as required to implement different statistical programs, so long as the same number is used consistently for comparison purposes. Each ball used in the system of the present invention is preferably coded with a different "bar code or other" alphanumerical combination, so that no pair of balls is labeled with the same code and each ball in any container is coded differently from all balls in any other container. Obviously, the size and shape of the container are not material to the invention, so long as the container is large enough to hold the predetermined number of balls and is shaped so that it can be carried and filled easily and conveniently. Likewise, the color, material and other physical characteristics of the container are not material.

Figure 2:
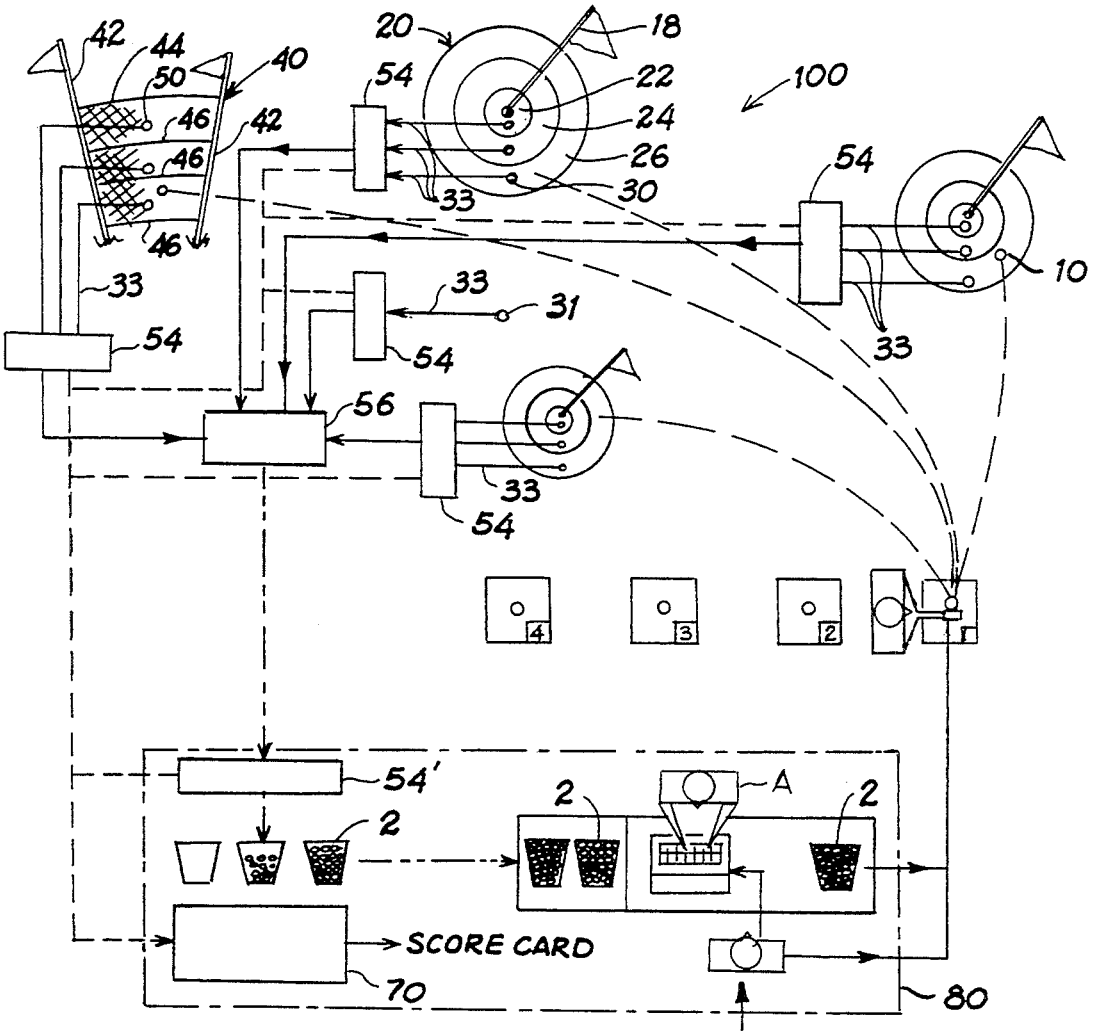
FIG. 2 is a schematic representation of an automated golf range according to the present invention.

FIG. 2 is a schematic representation of a golf driving range 100 according to this invention with a line of tee stands or stalls 16 at one end of an imaginary fairway. When a golfer G pays for and receives a bucket 2 of coded balls 10, he is directed to use an assigned tee stand, such as the number 1 stand illustrated in the figure, from where he hits each coded ball toward a target flag 18 within a target 20 of his choice. The line of tee stands may be either straight or slightly curved; if curved, the degree of curvature must be such that no golfer of normal ability driving or chipping in a usual manner would be likely to cause a propelled ball to hit another golfer positioned at any other tee stand.

Each flag 18 represents a hole within a target 20, preferably with the general visual characteristics of a golf course green, but not necessarily as large. The specific target dimensions may vary according to the size of the range and the number of targets present. Each of these targets 20 is shown as a circle in the figures for simplicity, but any geometry would be equivalently appropriate to practice this invention. Each target 20 preferably comprises a surface generally sloped toward the tee stands area and comprising multiple concentric annular sections corresponding to various distances from the flag 18, which is normally located approximately at the center of the target, but not necessarily so. Target 20 and flag 18 optionally simulates a green on a golf course. Thus, for example, a target may contain an inner section 22 surrounded by a concentric intermediate section 24, which is itself surrounded by a concentric outer section 26. As indicated above, the three inner, intermediate and outer sections (or any different number of sections chosen to be included in the target area, including only one) can obviously vary in size and shape, but are illustrated here as having annular shapes for simplicity.

Figure 4:
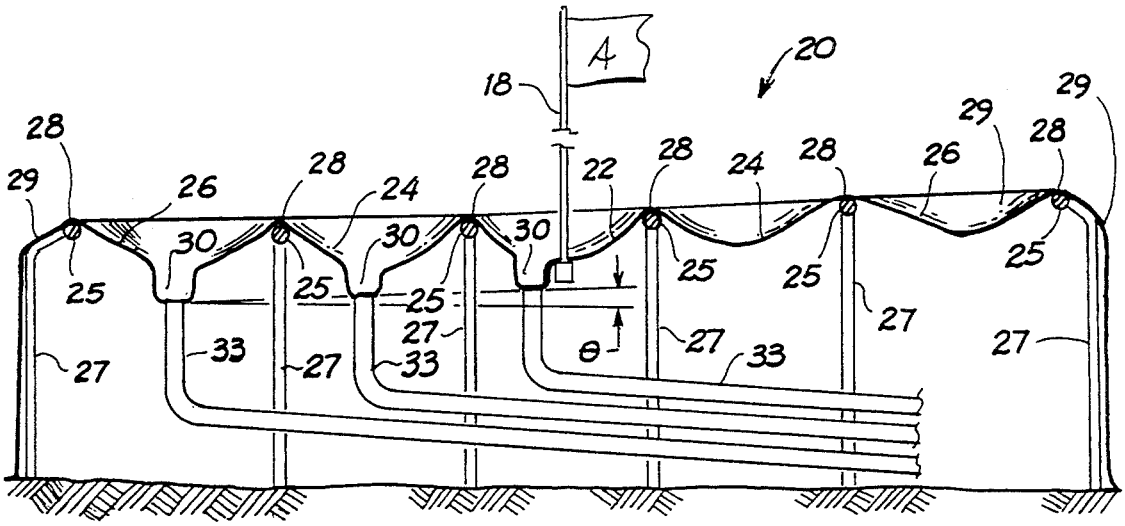
FIG. 4 is a cross-sectional view of the sloped circular target of FIG. 3 taken along line 4—4 in FIG. 5, illustrating the channel geometry and the ball-retrieval piping system associated with each section.
Figure 3:
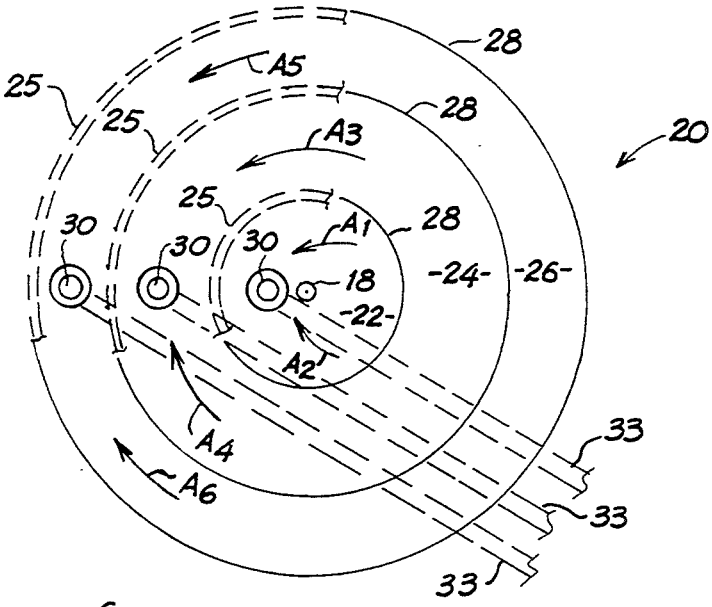
FIG. 3 is a plan view of a sloped circular target including three separate and concentric sections.

As illustrated in the plan and cross-sectional views of FIGS. 3 and 4, the surface of the inner section 22 preferably comprises a concave structure with an upper rim 28 defining its perimeter and boundary with the intermediate section 24. A receiving cup 30 is located next to the flag 18 at the lowest spot in the section, thus ensuring that any ball lying in the inner section 22 would roll into the cup by the force of gravity. Similarly, each of the annular sections 24 and 26 preferably comprises a circular channel with upper rims 28 defining an inner and an outer perimeter and boundaries with the adjacent sections. A cup 30 is also located at the lowest point of each section for receiving a golf ball that has landed within the perimeters of the section. Obviously, the lowest point is determined taking into account the curvature of the surface if any, as well as the slope of the target, if any. Moreover, the diameter of each receiving cup must be larger than that of the coded balls to be used on the range. Optimally, the slope of the target and the configuration of the various surface areas within the target, preferably causes any coded ball hit by a user and coming to lie at any point in the inner section to be moved by gravity into the cup in the inner section and any coded ball coming to lie at any point within either annular section will be moved by gravity to the lowermost part of the corresponding channel and then to the cup in that section. In turn, each cup 30 is preferably is connected to a tube 33 located below the cup and inclined toward a low point in the range where each coded ball is scanned and collected, as detailed below.

As clearly understood from the cross-sectional view of a target shown in FIG. 4, because the highest part of the inner section 22 is its circumferential rim 28, a ball coming to lie in the inner section will normally be trapped in that section and be unable to move outside the area beyond the rim. Rather, because of gravity it will roll into the section's cup 30 in the direction of either arrow A1 or A2. Likewise, the rims 28 constituting the boundaries of the annular sections 24 and 26 are the highest points of each; therefore, a ball that comes to lie in the intermediate section 24 will be unable to move to either of the adjacent inner and outer sections; and a ball that comes to lie in the outer section will be unable to move either to the adjacent intermediate section or off the target. Rather, they will move only toward their respective cups according to the shortest route in the direction of arrows A3, A4, A5 or A6.

In order to cause a golf ball to remain in the section within which it first lands, the surface of each section preferably is lined with material capable of absorbing the shock of a landing ball, so as to prevent it from bouncing out of the section. Depending on the specific structure constituting the target 20, this material may be part of the target's surface itself, rather than a lining. For example, the target 20 may be constructed by shaping the ground to the desired sectional geometry within the terrain of the range, in which case a lining of shock-absorbing spongy material (such as polyethylene foam) would be required to prevent bouncing of the golf balls. On the other hand, the target may be constructed as a stand-alone structure erected on the terrain existing on the range. As illustrated in partial view in FIG. 3 and in cross-sectional view in FIG. 4, this kind of structure could consist, for example, of multiple concentric rings 25 supported by vertical braces 27 anchored to the ground and covered by a continuous spread of canvas or similar material 29 constituting the surface of the various sections of the target. The material marketed by the Ludlow Corporation of Dothan, Ala., under the trademark "Textoline" is particularly suitable for this purpose because of its strength and yielding characteristics that make it easy to fit on a support structure and effective for trapping balls landing in the target. Of course, such a stand-alone target also affords the advantage of being movable, so that the configuration of the range may be changed from time to time. Finally, whether in stand-alone form or shaped out of the ground of the range, the target 20 may comprise a single section 22 with a single cup 30 connected to the lowest point in its surface.

As illustrated schematically in FIG. 2, a standing target 40 preferably consists of two supporting posts 42 placed upright and connected by a header crossbar 44 at the top and by multiple gutter crossbars 46 below dividing the vertical space between the posts 42 into multiple target sections (shown as three, for example, in the figures), preferably approximately equal in height and corresponding to different distances from each tee stand 16. As better seen in the perspective view of FIG. 5, each crossbar 46 is connected to a gutter 48 behind the vertical plane of each target section, and each gutter contains a receiving hole 50 at its low point for the collection of any ball landed in the gutter. In order to provide such low point, each crossbar may be attached to the poles 42 with a slight bias to one side or to the back of the running surface to create a slope toward a low point for the collection of balls by gravity. The resulting slope is such that a ball placed in the gutter at the higher end would move by gravity to the lower end and be trapped in the hole 50. As in the case of the cups 30, of course each hole 50 is larger than the diameter of the coded balls used by the range. Also, since this type of target would be used primarily to measure driver-shot distances, it should be positioned at the same distance from all tee stands; that is, it would be placed approximately at the center of the circle along the circumference of which the tee stands are located. Alternatively, the tee stands may be positioned at arbitrary distances from the target, so long as each distance is known and accounted for in scoring and evaluating the performance of a player.

Each of the three sections of air space bounded by the poles 42 and opposite pairs of crossbars is fitted with netting 52 attached to the poles, crossbars and gutters to collect any ball hit through the section. The netting must be attached securely enough to withstand the impact of flying balls, and yet its tension must be sufficiently loose to absorb the impact of the ball to cause it to fall into the gutter below, rather than bounce back and fall to the ground. Through empirical experimentation and trajectory calculations, it is possible to estimate the distance that a ball falling in each of the sections would have traveled if allowed to continue on its course. Obviously, higher sections correspond to longer distances. Thus, by hitting a ball to a section at a certain elevation and distance from the tee stand, the length of a shot can be approximated with good accuracy and recorded accordingly by the computerized apparatus described herein.

Each cup 30 in the sloped targets 20 and each hole 50 at the lower end of the gutter in each section of the standing target 40 are connected to an inclined system of tubing for the retrieval of the balls that landed within a target. In addition, at one or multiple low spots in the terrain outside the target areas, as dictated by the configuration of the range, a collection cup 31 may also be provided to gather all the balls that missed a target. Naturally, this feature would require the range area to be sufficiently sloped to cause a ball landing anywhere outside the targets to roll by gravity to one of these low collection cups (that is, the slope at any point must be greater than the natural angle of repose of the coded balls used in the range). Alternatively, once the balls have been received within the target, they can be passed through cup 30 to a scanner, as will be discussed more fully hereinbelow and remain in the region of the target. Thereafter, the balls can be manually or otherwise collected from the region of the target.

However, in accordance with a preferred aspect of the present invention, range 100 is advantageously configured so that cups are also coupled to inclined tubes that run all the way to the same central collection location. As illustrated schematically in FIG. 4, this tubing or piping system comprises routes 33 (which may be located underground) through which the coded balls 10 move from each cup or hole through an optical scanner 54 and to a collection container 56. The balls are caused to move through the tubing routes by gravity due to the placement of the tubing in a downwardly sloping fashion. The necessary slope may be achieved by positioning the range on terrain that slopes naturally (as illustrated by arrow A7 in FIG. 5) or it may be achieved artificially by creating a slope on an otherwise flat terrain by artificially increasing an inadequate natural slope or by placing the tubing underground in a way that creates an adequate slope for the tubing even though the range itself is relatively flat. Alternatively, a method other than gravity could be selected to cause the balls to move through the tubing, such as a pneumatic system (vacuum or forced air), hydraulic means (like flowing water), a mechanical conveyor-type system, or other known methods for moving objects through a pipe system. The diameter of the tubing must be large enough to permit a ball to move freely through it, but small enough to prevent balls from becoming lodged together. The material from which the tubing is made is of no consequence, so long as durable and smooth to facilitate the motion of coded balls through it. Alternatively, if a collection cup 31 is not provided on the range, the balls falling outside the target areas may be collected and put back into the system manually.

Figure 6:
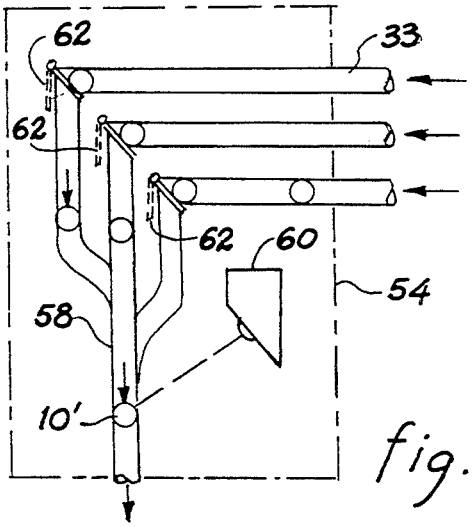
FIG. 6 illustrates in schematic view the structure and functioning of a scanner used to identify the coded balls of the invention.
Figure 7:
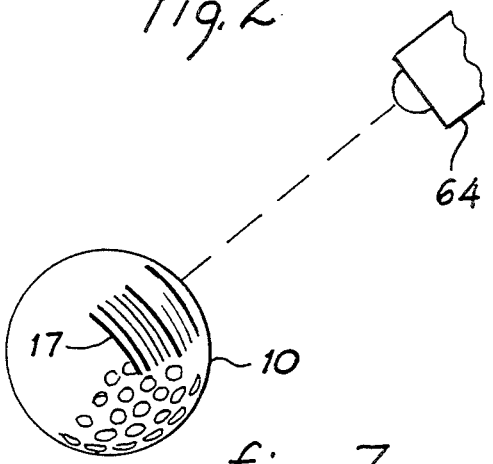
FIG. 7 illustrates the function of commercially available optical devices that see and recognize the code bars on a ball by scanning it with a laser beam directed toward the ball.

According to the schematic view of FIG. 2, a separate scanner 54 is located at the receiving end of the multiplicity of individual pipes 33 from or in the proximity of each cup 30 or hole 50 in a given target, or from a collection cup 31, so that a coded ball 10 arriving from the target can be identified and assigned to the particular cup or hole from which it arrives. FIG. 6 is a schematic representation of a scanner 54 at the receiving end of a three section target 20, wherein three separate pipes 33 are connected to the three separate cups 30 in each section of the target. Inside the scanner 54, each pipe 33 is provided with a gate 62 to interrupt the motion of a ball rolling therewithin while the scanning unit 60, positioned in viewing relation to the common pipe 58 downstream of the gates, reads the bar code imprinted on the last ball 10' released by one of the gates. The scanning operation can be accomplished using commercially available optical devices, such as the laser scanner Model LS 6100 manufactured by Symbol Technologies, Inc. of Bohemia, N.Y., that see and recognize the bars constituting a UPC label 12 on a coded ball 10 by scanning it with the laser source 64 directed toward the ball, as illustrated in FIG. 7. Each scanner 54 is tied to a central computer 70 through linking apparatus (not shown in the figures), such as the universal interphase controller sold by Symbol Technologies under the trade name Omni-Link, and the information concerning each scanned coded ball and the corresponding cup or hole from which it came is recorded as a score associated with the particular ball and the particular player who shot it. A gate 62 opens automatically when the ball 10' has been read, so that a new ball is released to continue downstream in the pipe 58 for scanning and identification. The balls are then either stored for collection at the site of each scanner 54 or gathered in a single collection container 56.

After collection from all containers, the balls are reused by refilling the buckets 2, either manually or automatically, with a number of balls for future players. As each new bucket is being filled, each ball is scanned again in a common scanner 54' to record its code in the computer as belonging to that bucket for the next player. Thus, the computer at all times keeps track of each coded ball in the system, which is necessary in order for it to be able to identify a ball passing through a given cup or hole in a target, assign a score to it, and record the score as belonging to a given player. As illustrated schematically in FIG. 2, a computing facility 70 is used to store data concerning a particular player, the tee stand assigned to him or her, the distances between each cup and hole and each tee stand, and to record the data produced by all scanners. The computer is programmed to identify each coded ball scanned, recognize it as belonging to a certain bucket and a certain player, and assign a certain score to it as a function of the distance between the tee stand assigned to that player and the hole or cup from which the ball arrived to the scanner. In addition, the computer may be programmed to calculate statistical information, store it, compare it to similar prior information for the same or other players, and produce a score card for the benefit of the player. Obviously, certain data must be entered into the computer as a matter of routine programing, such as current distances between the tee stalls and the various targets, which may vary periodically as the tees or targets are moved to allow turf regeneration or to change the configuration of the range.

It is anticipated that the central computing facility will be located in or near a pro shop or clubhouse 80, staffed by an attendant A for assigning tee stands and distributing buckets of coded balls to each player. When a golfer G pays for and receives a bucket 2 of coded balls, the attendant feeds into the computer the bucket number (which in turn triggers the identification of all coded balls assigned to that particular bucket during the loading procedure), and information indicating the particular tee stand to which the player has been assigned. The attendant also feeds into the computer a name, number or other identifying code or symbol unique to that particular player, which will be used to identify him each time he uses the range. Then, as the player hits his balls towards various targets, the balls that land within a target are identified, together with the sections where they landed, by the scanners and that information is automatically fed into the computer. Since the computer has a record of all balls assigned to a given player, it can keep track currently of all balls hit by all players and use that information to generate any desired statistics, as may have been programmed as a matter of design choice.

Thus, in operation, the system provides for a coded ball that has been hit by a golfer's driving or chipping action onto a target to move into a cup or hole, and then through a tubing route connected thereto through a scanner, and to a ball collection container. As each ball passes through a scanner, it is identified as arriving from a specific target section in the range and the information from each scanner is fed into a central computer 70. Because all coded balls hit by a player belong to a particular bucket and because the proper bucket/tee stand correlation was fed into the computer at the time the golfer received his bucket of coded balls, it is possible to determine how many of the balls propelled by a given player from a particular tee stand hit targets, identify which targets were hit, and record the distance each ball traveled from the tee stand to the lie and any derivative statistic such as, for example, the percentage of successful shots (i.e., the portion of total shots that hit targets). Points may be assigned arbitrarily according to the player's success in hitting the innermost section of a target as a measure of the quality of an approach shot toward the flag on a green. For example, 100 points may be assigned for a ball landing in the inner section of a target, 80 and 60 points for balls landing in the intermediate and outer sections, respectively, and zero points for balls landing outside the target. Because a golfer preferably always uses the same identifying name, number, code or symbol, the statistical information developed during a given session can be stored for comparison with similar information from past or future sessions.

In order to normalize the scoring procedure, it is anticipated that a formula would be used rewarding equally a player who hits a small target from a short distance as one who hits a large target from a farther tee stand. Also, the formula should assign scores in relative numbers that an average golfer would consider fair in view of the difficulty of the shot. For example, a formula such as follows would achieve that result:

$$S = K \times \frac{(D - 25)^2}{(R + 1)^2} \times W$$

where

D is the distance in feet between the tee and the target;

R is the effective radius of the target in feet;

K is a normalization coefficient;

W is a weighting factor to account for different wheather conditions; and

S is the number of points awarded to a successful shot.

This-formula is weighted to reward accuracy in distance and in direction in a way that reflects what most golfers perceive to be a true measurement of difficulty for comparable shots in a golf course. Using this formula to calculate scores with a normalization coefficient and a weather factor of 1, for example, a hit of a 5-foot (in radius) target from 100, 150 and 200 yards would yield 21, 50 and 91 points, respectively, while a hit of a 15-foot target from the same distances would score 3, 7 and 13 points, respectively. This appears to be in line with the average golfer's measure of the difficulty involved with comparable shots on a course.

Figure 8:
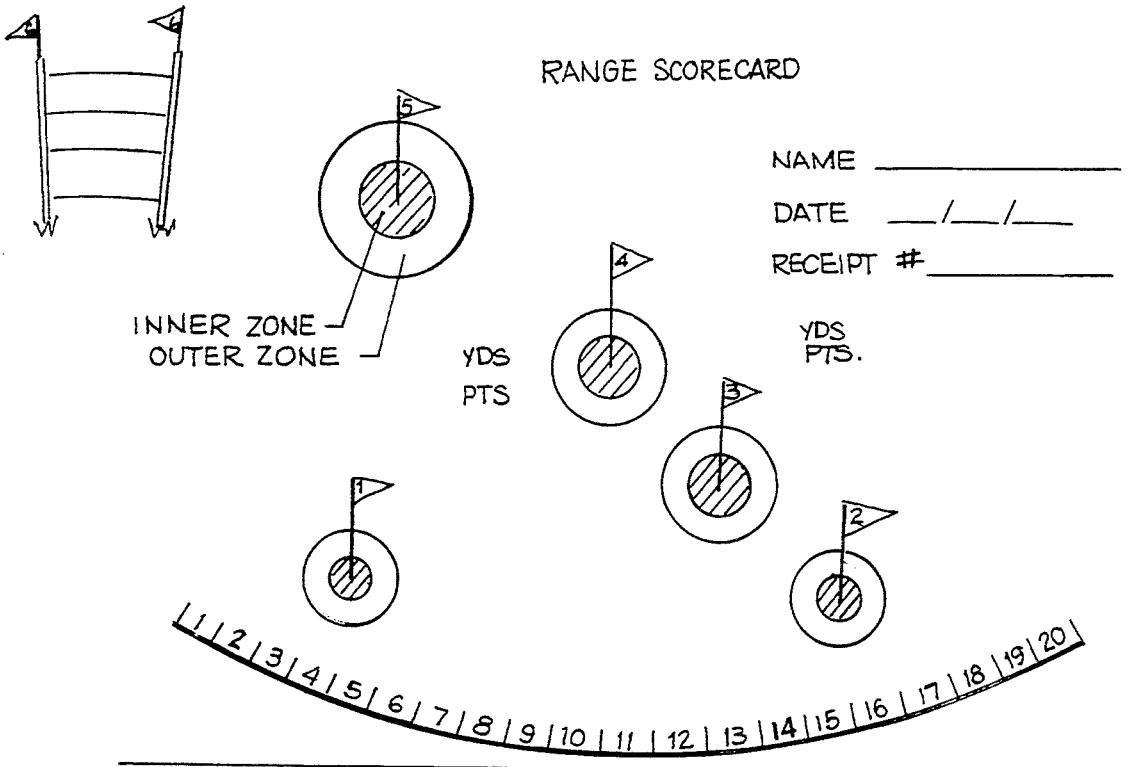
FIG. 8 is an example of a score card as may be produced to reflect the performance of a player using the range of the invention.

After a golfer has completed a session, he proceeds to the clubhouse where he receives a score card reporting and analyzing his performance. As illustrated in FIG. 8 for a hypothetical range with five two-section circular targets and one three section vertical target, the score card could indicate, for example, the number of shots that hit a given section of each target and the corresponding cumulative score. Because the player uses the same identifying name or code each time he uses the range, this information could be combined with prior information to provide for comparison data such as "This Month," "Year-To-Date," "All-Time," and "Average" statistics. The same information could also be provided for comparison purposes about other golfers similarly identified by name, if desired. Further comparisons could be offered by providing statistics in categories broken down by sex, age groupings, or any other meaningful criterion. Obviously, these choices could easily be programmed by one skilled in the art into the computer 70 controlling the operation.

It is found that any programmable personal computer capable of interactive connection with a scanner is suitable for practicing this invention. In essence, the computer preferably is programmed to contain all the relevant information concerning the range, such as distances and values associated with each target section from each tee stand. It preferably also is programmed to receive identifying information concerning the player, the tee stand and bucket codes assigned to him, and the input from the various scanners reporting what balls have passed through what specific receiving cups (which, of course, correspond to various targets and sections). Finally, the computer preferably is programmed to calculate and store any statistical information deemed of interest and to print a score card according to a desired format.

Figure 5:
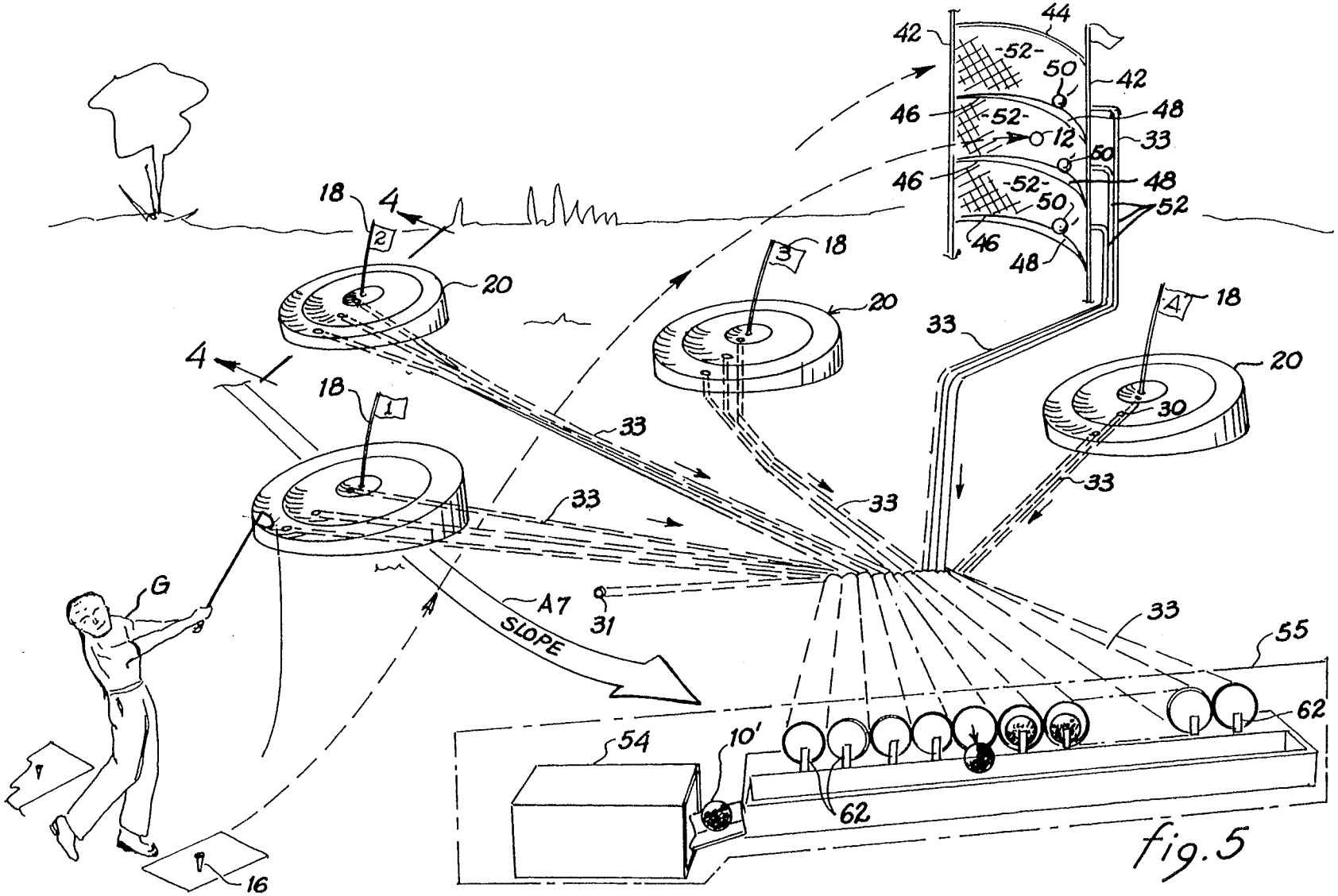
FIG. 5 is a schematic perspective view of a sloped driving range according to this invention.

The number and placement of the scanners 54 may vary in different embodiments of the invention. For instance, a single scanner located at a low spot in the range could be used for all balls gathered from the various target and range sections, as illustrated in FIG. 5. In that case, as seen in the enlarged portion 55 in the figure, each pipe 33 connected to a cup or hole would feed a common scanner 54 through a system of gates 62 operating on the same principle described above. That is, through a control mechanism not shown in the figures the scanner would sense which gate is open, identify the ball 10' released therefrom, and feed that information to the computer 70. Then, the scanner would automatically open another gate to release another ball to generate a new set of information for the computer. Of course, each gate would be controlled in such a way as to ensure that only one ball is released at any given time.

While the present invention is illustrated as having ball collection containers at some point within the range from where the balls are recovered for recycling into the system through the common scanner 54' it is anticipated that the piping system could be extended to cover the entire surface of the area, so that the collection and recycling of all balls could be accomplished automatically. This, of course, would require either a favorable slope throughout the range or a mechanized system for moving the balls, rather than by gravity. Alternatively, the balls could be manually recovered from the scanner associated with and advantageously adjacent each respective target.

Various changes in the details, steps and materials that have been described may be made by those skilled in the art within the principles and scope of the invention herein illustrated and defined-in the appended claims. Therefore, while the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

I claim:

1. A golf driving and chipping range featuring the automatic retrieval of balls and the compilation of statistical data relates to the performance of a player, comprising:

(a) a driving range area;

(b) multiple sets of golf balls having a coded inscription marked thereon capable of recognition by scanning equipment, wherein each set comprises a fixed number of balls available to a player and all balls of all sets have a different code;

(c) a multiplicity of sloped curvilinear targets placed in said range area, each target containing at least one section having a concave cross-sectional surface with a receiving cup at the lowest point thereof, wherein the slope anywhere on the surface of the section is sufficient to cause said ball to roll by gravity to said receiving cup;

(d) a system of inclined pipes connected to each of said receiving cups from the targets in the range area to carry said coded balls from any of said cups to a collection container;

(e) first automatic scanning means coupled to said system of inclined pipes for viewing and identifying the code on each ball in said multiple sets of coded golf balls after it passes through any one of said receiving cups;

(f) second automatic scanning means for recording the individual codes of said coded balls as they are being used to reconstitute said multiple sets of golfing balls comprising a fixed number of balls;

(g) programmable computer means, connected to said first and second scanning means for receiving input signals related to the code and target section corresponding to each ball received through a cup and to the code of each ball used to constitute each of said sets of multiple golf balls, and available to a user for entering information related to individual players, wherein said computing means identifies each coded ball passing through said cups and calculates, stores and reports statistical data concerning the performance of each player; and (h) multiple tee stands on said range area from any one of which a player can hit a said set of coded balls toward said multiple targets.

2. The automated range described in claim 1, wherein the coded inscriptions marked on said coded balls are scattered randomly around the surface of the ball.

3. The automated range described in claim 1, wherein the coded inscriptions marked on said coded balls are repeated longitudinally along the circumference of the ball.

4. The automated range described in claim 1, wherein the coded inscriptions marked on said coded balls are repeated radially over the surface of the ball.

5. The automated range described in claim 1, wherein an equatorial line is added to said coded balls at a fixed distance from each of said coded inscriptions in order to give said scanning means an added frame of reference to enhance code recognition.

6. A golf driving range comprising:

a driving range area;

a plurality of coded golf balls, each of said golf balls having a different bar code thereon, said bar-coded golf balls being arrangeable into at least one set comprising a predetermined number of said golf balls;

at least one target in said driving range area, said target having at least one ball receiving region contained therein for receiving any of said golf balls of said set which is hit into and maintained in said target;

at least one teeing position in said driving range from which a player can hit said set of coded golf balls toward said target;

a bar code scanner to identify said coded golf balls within said set prior to said golf balls of said set being hit toward said target, and to identify any of said golf balls of said set which are hit from said teeing position and which are hit into and are maintained in said target; and a computer system for receiving and processing input related to a player, said at least one target and said at least one teeing position, said computer system being operably connected to said scanner for receiving and processing inputs related to said coded golf balls and said target or targets into which said golf balls are hit, whereby statistical data regarding the player's performance is obtained.

7. The driving range of claim 6, comprising a plurality of targets and multiple tee stands wherein at least one of said targets comprises a multilevel vertical target for driver shots located at a fixed distance from each of said multiple tee stands, wherein each level of said multilevel target includes a receiving region and a gutter connected to said scanner.

8. The driving range of claim 7 wherein said net is attached to said multilevel target securely enough to withstand the impact of flying balls, and yet sufficiently loose to absorb the impact of the ball to cause it to fall into the gutter below, rather than bounce back and fall to the ground.

9. The driving range of claim 7, wherein said scanner comprises multiple gates for interrupting the motion of a golf ball arriving from any of said receiving regions and said gutters, and comprises a scanning unit positioned in viewing relation to the output of each of said gates, whereby each said ball is stopped to permit the individual scanning of each said ball.

10. The driving range of claim 6, comprising a plurality of targets wherein at least one of said targets comprises a circular inner section surrounded by at least one annular section concentric thereto.

11. The driving range of claim 6, wherein said driving range is sloped and comprises at least one low point with a receiving region for gathering coded balls that land outside said target or targets, wherein the slope anywhere in the range area is sufficient to cause said balls to roll by gravity to said at least one low point and into said receiving region.

12. The driving range of claim 11, further comprising a transfer system to effect movement of said coded balls from said at least one low point and from said target or targets to a collection center.

13. A driving range for use by a golfer comprising:

at least one tee position;

at least one target located a predetermined distance from said tee position;

a plurality of bar-coded golf balls which can be hit from said tee position toward said target by the golfer;

a first bar code scanner to provide a first identification of said coded golf balls prior to said coded golf balls being hit from said tee position;

a second bar code scanner to provide a second identification of said coded golf balls which are hit from said tee position into said target; and a computer programmable to receive inputs from said first and second scanners reflective of said first and second identifications and to compile statistical data of the golfer's performance.

14. The driving range of claim 13, wherein said first scanner and said second scanner comprise the same scanner.

15. The driving range of claim 13, wherein said plurality of bar-coded golf balls are arrangeable into sets of a predetermined number of golf balls.

16. The driving range of claim 15, further comprising at least two targets, wherein said second scanner further provides a first identification of the target into which said coded golf ball is hit into and maintained within, and wherein said first target identification is also receivable by said computer.

17. The driving range of claim 16, further comprising at least two tee positions.

18. The driving range of claim 15, wherein said target comprises at least one ball receiving area and at least one ball receiving cup within said ball receiving area.

19. The driving range of claim 18, further comprising a collection container and a system of inclined pipes to carry said coded balls within said ball receiving cup to said collection container.

20. The driving range of claim 19, further comprising a transfer system to carry coded balls which are hit from said tee position toward said target, but which do not land in said target to said collection container.

21. The driving range of claim 20, wherein said collection container is located adjacent to said target.

22. The driving range of claim 16, wherein said computer is further programmable to compile a report summarizing golfer performance.

23. The driving range of claim 18, wherein said sets of coded golf balls are scanned by said first scanner as said set is constituted, and wherein said second scanner is operable to identify any of said coded balls of said set which are received in said ball receiving cup.

24. The driving range of claim 23, wherein said second scanner is operably connected to said at least two said targets, said driving range further comprising a transfer system to transfer said coded balls received within said targets from said ball receiving cup to said second scanner.

* * * * *